US006254084B1

(12) United States Patent
Hellmer

(10) Patent No.: US 6,254,084 B1
(45) Date of Patent: Jul. 3, 2001

(54) PAPER FEED ENHANCER FOR PRINTER FEEDER

(75) Inventor: Andrew D. Hellmer, Center Moriches, NY (US)

(73) Assignee: Olympus America Inc., Melville, NY (US)

( * ) Notice: Subject to any disclaimer, the term of this patent is extended or adjusted under 35 U.S.C. 154(b) by 0 days.

(21) Appl. No.: 09/377,388

(22) Filed: Aug. 19, 1999

(51) Int. Cl.[7] ..... B65H 1/08; B65H 1/00; B65H 1/22

(52) U.S. Cl. ..... 271/126; 221/148; 221/161; 221/164

(58) Field of Search ..... 271/126, 148, 271/164, 162, 161 C

(56) References Cited

U.S. PATENT DOCUMENTS

| | | | | |
|---|---|---|---|---|
| 2,471,066 | * | 5/1949 | Hesson | 271/62 X |
| 3,022,997 | * | 2/1962 | Pendley | 271/27 X |
| 3,239,218 | * | 3/1966 | Reeves | 271/148 |
| 4,535,982 | * | 8/1985 | Mochimaru | 271/162 |
| 4,616,773 | | 10/1986 | Kerivan . | |
| 5,118,209 | | 6/1992 | Bennet et al. . | |
| 5,204,537 | | 4/1993 | Bennet et al. . | |
| 5,230,503 | * | 7/1993 | Saito et al. | 271/121 X |
| 5,277,418 | * | 1/1994 | Jones et al. | 271/164 |

FOREIGN PATENT DOCUMENTS

| | | | | |
|---|---|---|---|---|
| 0161735 | * | 12/1980 | (JP) | 271/126 |
| 0048843 | * | 3/1985 | (JP) | 271/126 |
| 0221039 | * | 9/1990 | (JP) | 271/162 |

* cited by examiner

*Primary Examiner*—Christopher P. Ellis
*Assistant Examiner*—Kenneth W Bower
(74) *Attorney, Agent, or Firm*—Scully, Scott, Murphy & Presser

(57) ABSTRACT

A feed enhancer for eliminating an unevenness in height from a paper stack to be printed by a printer. The printer has a paper feeder including a paper tray for storage of the paper stack on a top surface thereof and for feeding individual paper from the paper stack into the printer for subsequent printing. The feed enhancer has an elongated strip disposed at the top surface of the paper tray and positioned perpendicular to a direction in which the individual paper is fed into the printer such that the feed enhancer evens out the unevenness in height of the paper stack in an area of the paper stack that is to be fed into the printer. Also provided are a printer and printer tray having the feed enhancer of the present invention.

24 Claims, 7 Drawing Sheets

PAPER FEED ENHANCER FOR PRINTER FEEDER

BACKGROUND OF THE INVENTION

1. Field of the Invention

The field of art to which this invention relates is-printers, in particular, a feed enhancer for a high volume printer having a top-feeder in which paper stock having labels and/or perforations are fed into the printer.

2. Description of the Related Art

In printers of the prior art, particularly those which employ a top-feeder for storing and feeding paper into the printer, paper which has a label affixed thereto or which has one or more perforations presents a problem in that it does not properly feed into the printer. Printing on such paper is particularly troublesome because the paper does not sit flatly upon a feeder tray due to the labels or perforations.

A typical printer 100 of the prior art having such a top-feeder paper feed arrangement is shown in FIGS. 1A and 1B. The top-feeder 102 generally includes a paper tray 103 and employs a pick roller 104 for contacting and feeding a sheet of paper 106 from the top of a paper stack 108 into the printer 100. A gearbox and motor assembly 110 drive the pinch roller as necessary to feed the paper 108. If the paper in the paper stack 108 does not sit flatly on the paper tray 103, the pick roller 104, which is generally located in the center of the paper along a central axis C—C, does not effectively engage and feed the paper 108 into the printer 100.

Examples of types of paper which do not lie flatly on the paper tray 103, are illustrated in FIGS. 2A–2C. Respective stacks of the types of paper illustrated in FIGS. 2A–2C are illustrated in FIGS. 3A–3C together with the paper tray 103 and pick roller 104 of FIG. 1.

FIG. 2A illustrates a sheet of paper 200 having a label 202 on one side. The label 202 adds a significant thickness to the overall thickness of the sheet of paper 200 in the area of the label 202. As can be seen in FIG. 3A, when stacked on a paper tray 103 of a printer 100 having a top feeder 102, the paper 200 has a greater height (H1) on the side with the label 202 than the height (H2) on the side without the label 202. Because of this uneven height (H1>H2), the pick roller 104 only engages the paper 200 on a portion of its width and causes the paper 200 to rotate as it is being fed into the printer 100.

FIG. 2B illustrates a sheet of paper 210, having two perforations 212. The perforations 212 run in the same direction as the direction that the paper 210 is fed into the printer 100. As can be seen in FIG. 3B, when stacked on a paper tray 103 of a printer 100 having a top feeder 102, the paper 210 has a greater height (H3) on the sides than in the middle (H4) (alternatively, if the paper stack is turned 180 degrees such that the top sheet is at the bottom, the paper stack will have a peak at each of the perforations resulting in an M-shaped stack). Because of this uneven height (H3>H4), the pick roller 104 does not properly engage the paper 210 leading to improper feeding of the paper 210 into the printer 100.

FIG. 2C illustrates a sheet of paper 220, having a single perforation 222. The perforation 222 runs in a direction perpendicular to the direction that the paper 220 is fed into the printer 100. As can be seen in FIG. 3C, when stacked on a paper tray 103 of a printer 100 having a top feeder 102, looking from the side of the paper stack, a portion 224 of the paper 220 decreases in height from the perforation 222 to the end of the paper 226. (alternatively, if the paper stack is turned 180 degrees such that the top sheet is at the bottom, the portion 224 will increase in height from the perforation 222 to the end of the paper 226). Because of this uneven height, the pick roller 104 does not properly engage the paper 210 leading to improper feeding of the paper 210 into the printer 100.

These problems ultimately cause the paper 200, 210, 220 to jam in the printer 100 resulting in downtime of the printer 100 and possibly, expensive maintenance. It should be apparent to those skilled in the art, that these paper configurations are given by way of example only and not as an exhaustive listing thereof. For example the paper may have a combination of those shown or others not shown such as pre-printed stock which has a tendency to curl when stacked upon the printer tray 103.

Devices are known in the prior art for addressing the uneven thickness and shape of paper to be fed into a printer. The prior art teaches devices for compensating for variations in the thickness between individual sheets of a paper stack being fed into a printer. The prior art devices achieve their objective by sensing the thickness of each piece of paper being fed into the printer and adjusting certain parameters within the printer according to the sensed thickness.
While these devices have their advantages, they are generally complex, costly, and difficult to implement on existing printer designs.

For these reasons a feed enhancer is needed which is simple, inexpensive, easy to retrofit onto existing printers and which can compensate for paper stacks that do not lie flatly and evenly upon a printer feeder which are to be fed into a printer, particularly one which employs a top-feeder system.

SUMMARY OF THE INVENTION

Therefore, it is an object of the present invention to provide a simple feed enhancer for a printer.

It is a yet a further object of the present invention to provide an inexpensive feed enhancer for a printer.

It is still yet another object of the present invention to provide a feed enhancer which is easily retrofitted onto existing printers.

Accordingly, the present invention provides a feed enhancer disposed on a surface of a paper feeder tray to compensate for variations in height and/or shape of a paper stack placed upon the paper feeder tray caused by labels or perforations in/on the individual paper in the stack. The feed enhancer is disposed perpendicular to the direction that the paper is fed into the printer.

In a first variation of the feed enhancer of the present invention, a feed enhancer for eliminating an unevenness in height from a paper stack to be printed by a printer is provided. The printer has a paper feeder including a paper tray for storage of the paper stack on a top surface thereof and for feeding individual paper from the paper stack into the printer for subsequent printing. The feed enhancer comprises an elongated strip disposed at the top surface of the paper tray and positioned perpendicular to a direction in which the individual paper is fed into the printer such that the feed enhancer evens out the unevenness in height of the paper stack in an area of the paper stack that is to be fed into the printer.

In a second variation of the feed enhancer of the present invention, a printer tray for eliminating an unevenness in height from a paper stack to be printed by a printer is provided. The printer has a paper feeder including the paper tray for storage of the paper stack on a top surface thereof and for feeding individual paper from the paper stack into the printer for subsequent printing. The printer tray comprises a feed enhancer having a heightened portion disposed at the top surface of the paper tray and positioned perpendicular to a direction in which the individual paper is fed into the printer such that the feed enhancer evens out the unevenness in height of the paper stack in an area of the paper stack that is to be fed into the printer.

In a third variation of the feed enhancer of the present invention, a printer for eliminating an unevenness in height from a paper stack to be printed is provided. The printer has a paper feeder including a paper tray for storage of the paper stack on a top surface thereof and for feeding individual paper from the paper stack into the printer for subsequent printing. The printer comprises a feed enhancer having a heightened portion disposed at the top surface of the paper tray and positioned perpendicular to a direction in which the individual paper is fed into the printer such that the feed enhancer evens out the unevenness in height of the paper stack in an area of the paper stack that is to be fed into the printer.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENTS

Figure 2A:
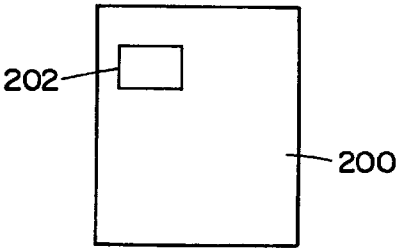
FIGS. 2A–2C illustrate examples of paper types which do not sit evenly on a feeder tray of the printer of FIG. 1.
Figure 2B:
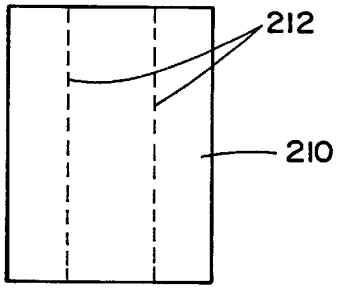
Figure 2C:
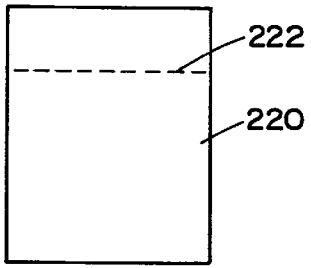

Although this invention is applicable to numerous and various types of printers and paper, it has been found particularly useful in the environment of printers employing a top-feeder and the types of paper illustrated in FIGS. 2A–2C. Therefore, without limiting the applicability of the invention to top-feeder printers and the types of paper illustrated in FIGS. 2A–2C, the invention will be described in such environment.

Figure 4:
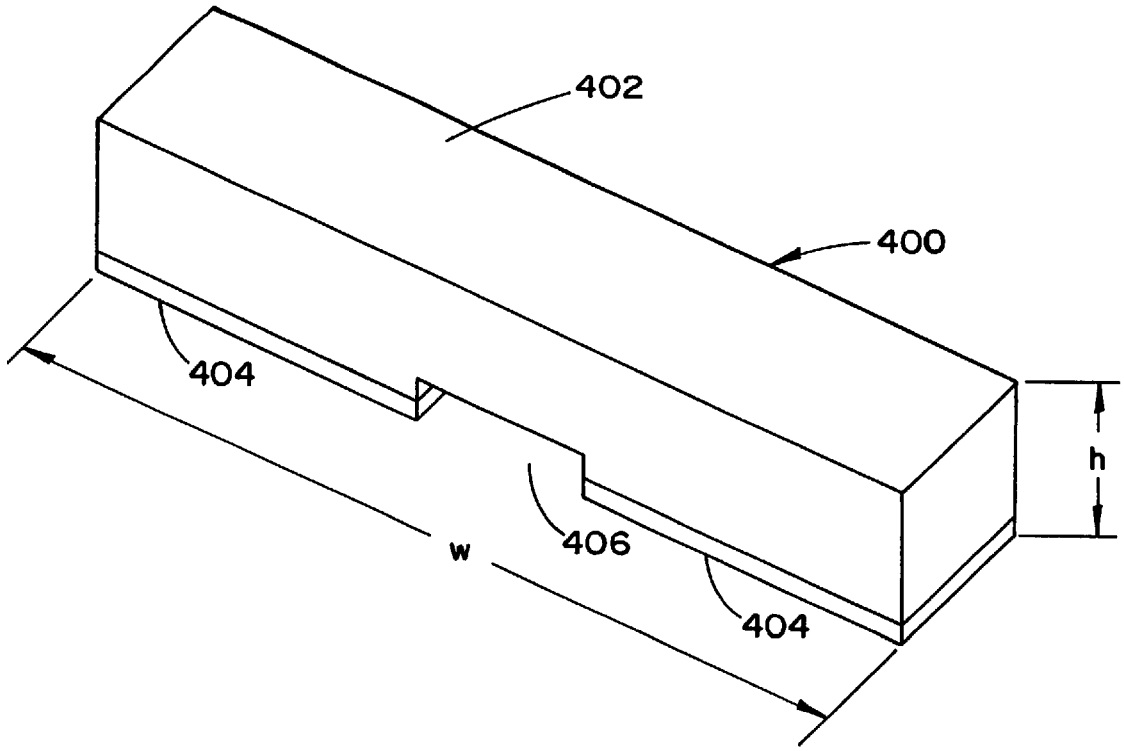
FIG. 4 is a isometric view of the first embodiment of the feed enhancer of the present invention.

Referring now in detail to FIG. 4, a first embodiment of a feed enhancer for eliminating an unevenness in height from a paper stack to be printed upon by a printer 100 is provided. The first embodiment feed enhancer is generally referred to by reference numeral 400. The feed enhancer 400 comprises an elongated strip 402 which is preferably fabricated from aluminum and is preferably 1" or less in height (h). The elongated strip 402 is preferably the same width (w) or smaller as the width of the paper being fed into the printer 100. For example, if 8½×11 inch paper is being fed into the printer with the 8½ inch side first, the feed enhancer would have a maximum width w=8½ inches and preferably not less than 6 inches wide.

The feed enhancer 400 is disposed on a top surface 103*a* of the paper tray 103 and positioned perpendicular to a direction in which the individual paper is fed into the printer 100 such that the feed enhancer 400 evens out the unevenness in height of the paper stack in an area of the paper stack that is to be fed into the printer 100.

The feed enhancer 400 preferably also has a mounting means for mounting the elongated strip 402 to the top surface 103*a* of the paper tray 103. In the typical case, the top surface 103*a* of the paper tray 103 is ferric and the mounting means is a magnetic strip 404 fastened to the elongated strip 402 whereby the elongated strip 402 is mounted to the top surface 103*a* of the paper tray 103 by a magnetic attraction between the magnetic strip 404 attached thereto and the top surface 103*a* of the paper tray 103. Preferably, the magnetic strip 404 is fastened to the elongated strip 402 with an adhesive. The feed enhancer of FIG. 4 is shown with a cut-out 406 dividing the magnetic strip 404 into two sections. The cut-out allows the elongated strip 404 to not interfere with any raised projections or irregularities (not shown) on the top surface 103*a* of the paper tray 103 that may correspond to the area of the cut-out thereby permitting the feed enhancer 400 to sit flushly on the top surface 103*a* on the paper tray 103.

Figure 1A:
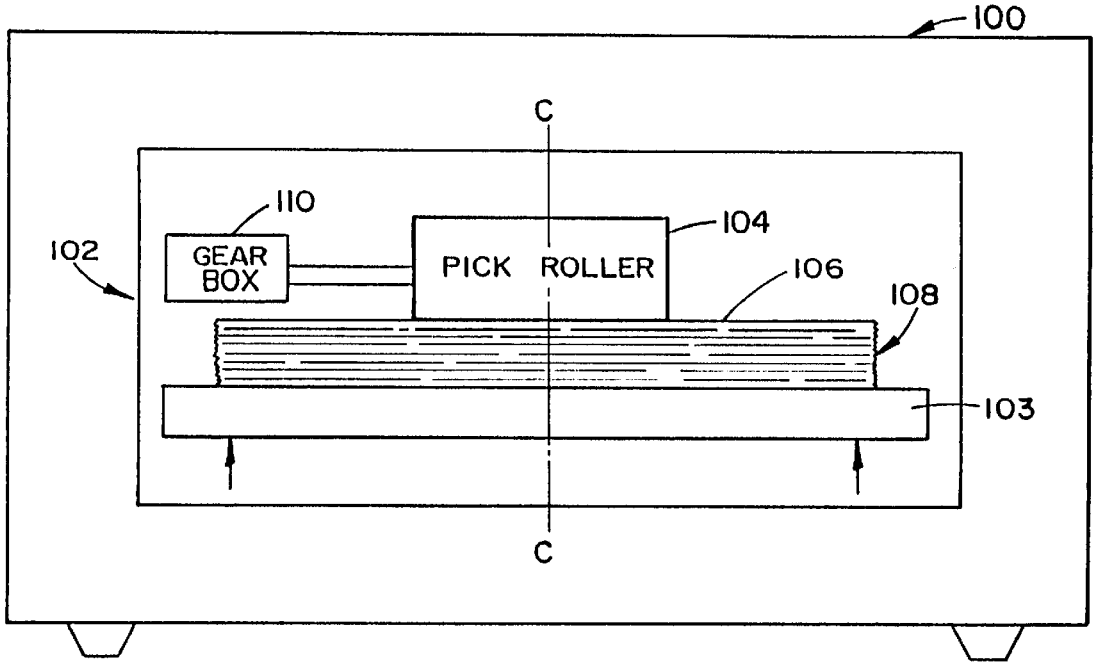
FIG. 1A (PRIOR ART)
FIGS. 1A and 1B are a front and side view, respectively, of a paper feeder of the prior art illustrating a stack of paper to be printed thereupon.
Figure 1B:
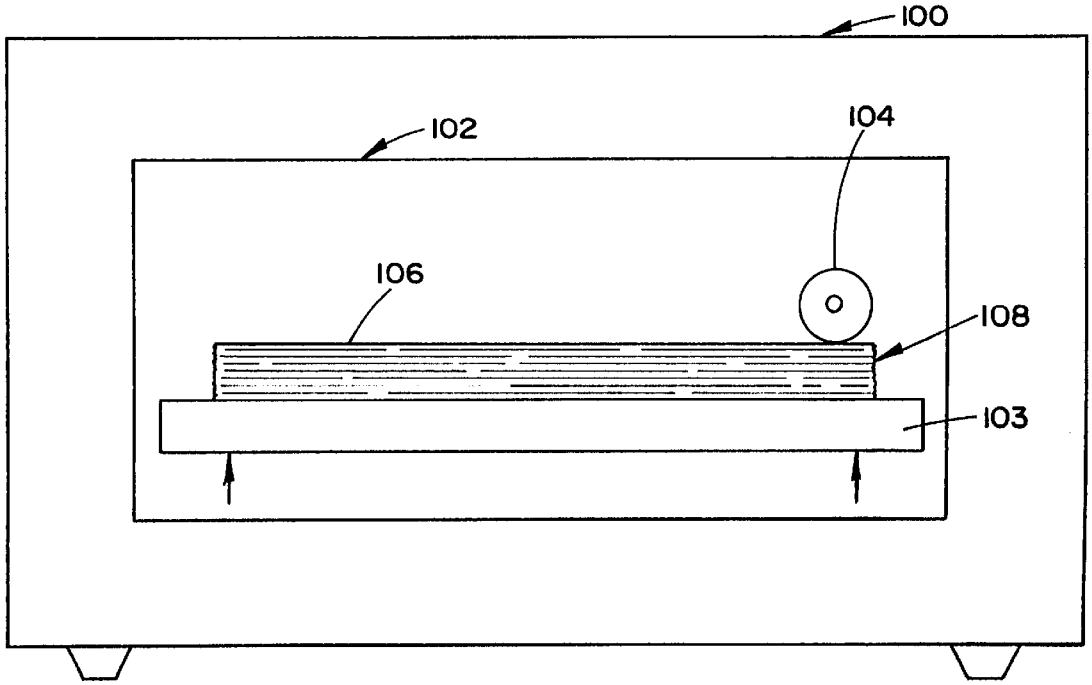
FIG. 1B (PRIOR ART)
Figure 3A:
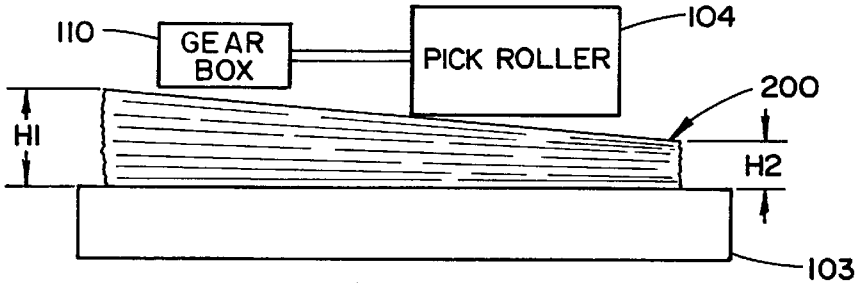
FIG.3A (PRIOR ART)
FIGS. 3A–3C illustrate respective paper stacks of the paper types of FIGS. 2A–2C shown sitting upon the paper tray of the printer of FIG. 1.
Figure 3B:
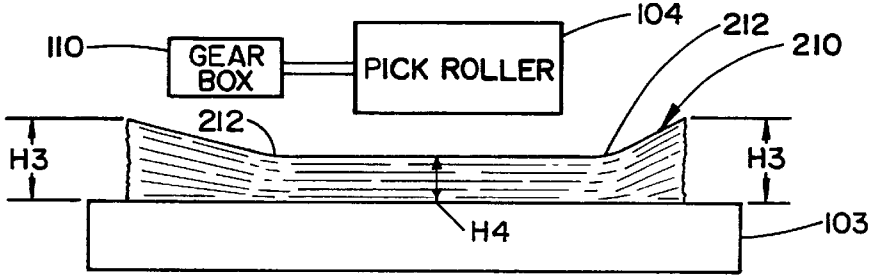
FIG.3B (PRIOR ART)
Figure 3C:
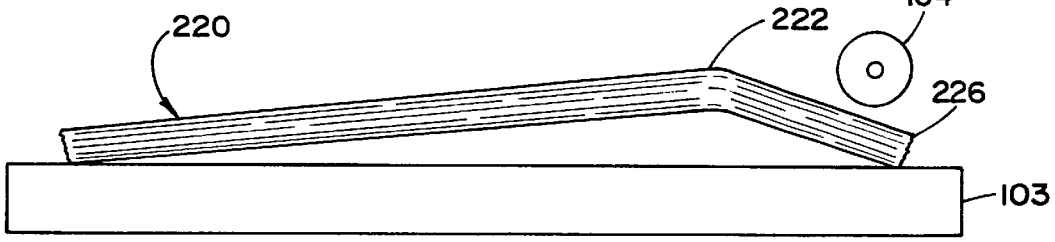
FIG.3C (PRIOR ART)
Figure 5A:
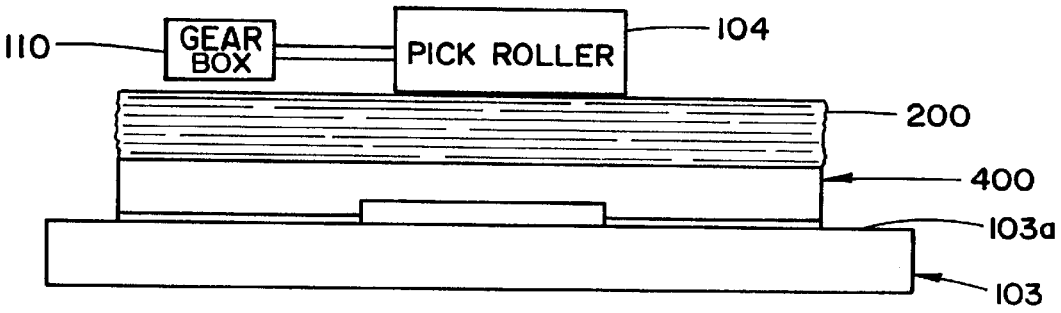
FIGS. 5A–5C illustrate the respective paper types and stacks of FIGS. 3A–3C shown with the first embodiment of the feed enhancer of the present invention.
Figure 5B:
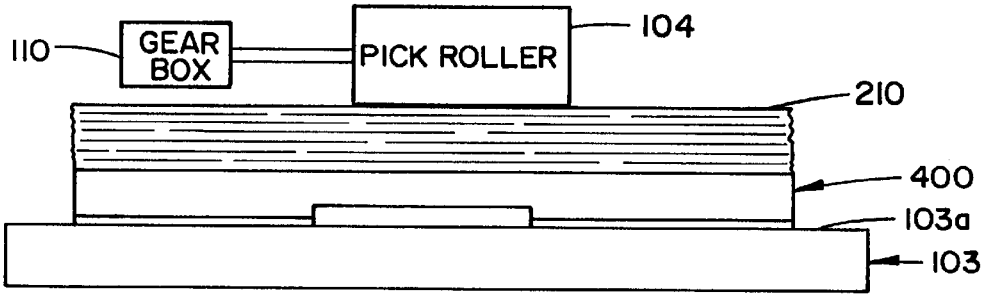
Figure 5C:
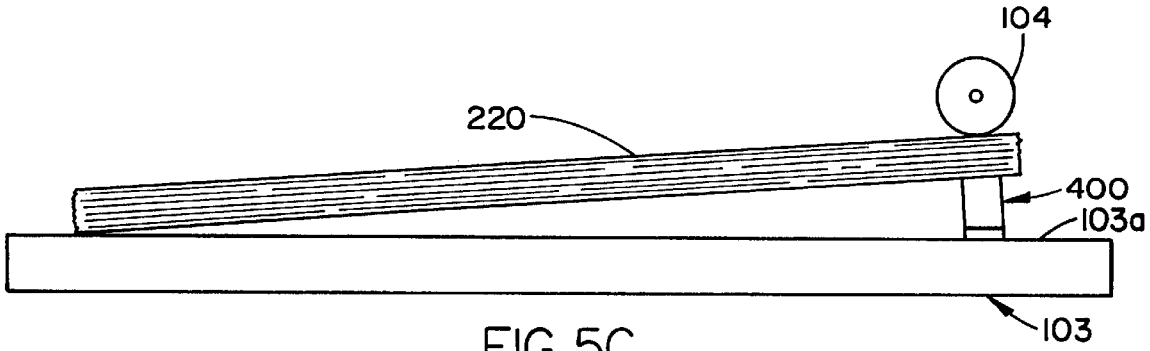

Referring now to FIGS. 5A–5C, therein are illustrated views corresponding to FIGS. 3A–3C but shown with the feed enhancer of FIG. 4 disposed on the top surface 103*a* of the paper tray 103 in which the unevenness in the height of the paper stacks 200, 210, 220, respectively, is evened-out in the area of the pick roller. It should be apparent to those skilled in the art, that the paper 200, 210, 220 illustrated in FIGS. 5A–5C, respectively, will feed properly into the printer 100, thereby reducing the likelihood that the paper will become jammed therein.

Figure 6:
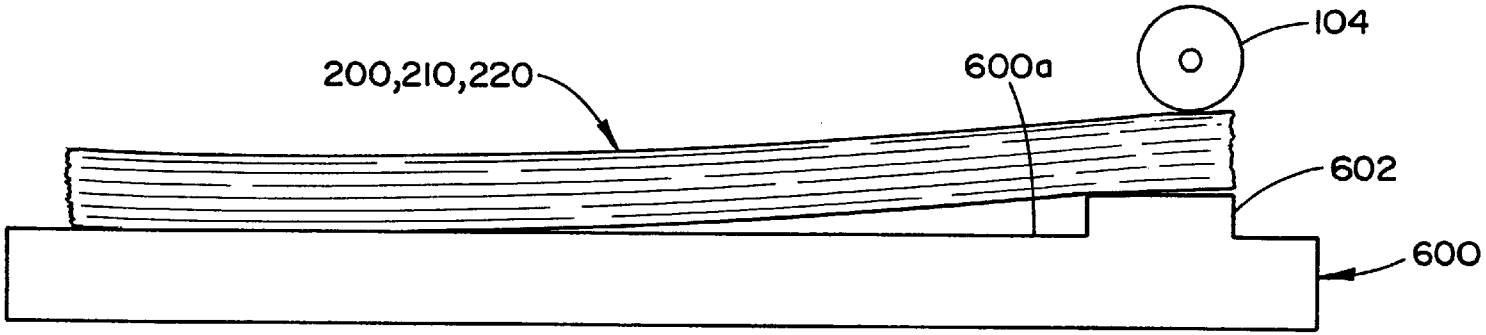
FIG. 6 is a side view of a second embodiment of a paper tray having the feed enhancer of the present invention.

Referring now to FIG. 6, a second embodiment of the feed enhancer of the present invention is illustrated therein. FIG. 6 illustrates a printer tray 600 which has a heightened portion 602 disposed at the top surface of the paper tray 600 and positioned perpendicular to a direction in which the individual paper is fed into the printer 100. The heightened portion 602 preferably comprises a stepped portion integral with a top surface 600*a* of the paper tray 600. The dimensions of the heightened portion 602 are preferably the same as discussed previously with respect to the feed enhancer of FIG. 4.

Figure 7:
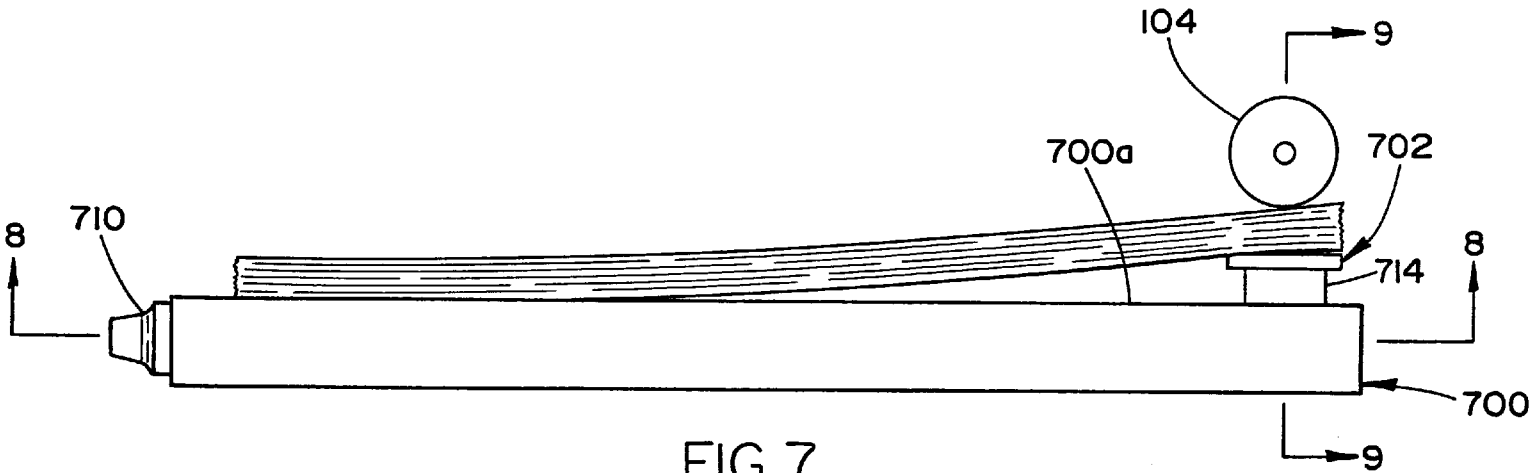
FIG. 7 is a side view of a third embodiment of a paper tray having the feed enhancer of the present invention.

Referring now to FIG. 7, there is illustrated a third embodiment of the feed enhancer of the present invention in which a paper tray 700 has a heightened portion. The heightened portion comprises an elongated strip 702 and an adjustment means for adjusting the height of the elongated strip 702 above the top surface of the paper tray.

Referring now to FIGS. 8A, 8B, 9A, and 9B, the adjustment means preferably comprises a shaft 704 rotatably disposed in the paper tray 700 through openings 706, 708. The shaft 704 is retained in the openings 706, 708 at a first end with a knob 710, preferably press fit onto the shaft 704, and at a second end with a retaining ring 712. A cam 714 is disposed on the shaft 704 which has an outer surface 716 which varies in distance from a central axis A—A of the shaft 704. A portion of the outer surface 716*a* is in contact with the elongated strip 702 through opening 718*a*. The knob 710 is preferably accessible from a front of the paper tray 700 such that a user can easily access the knob 710 and rotate it, thus rotating the cam 714 about the shaft 704.

Retaining means retains the elongated strip 702 along a path B—B perpendicular to the top surface 700*a* of the paper tray 700. Preferably the retaining means comprises at least two shafts 720 perpendicular to the top surface 700*a* of the paper tray 700 (in other words, parallel to the movement of the elongated strip 702 along axis B—B). The shafts 720 have a first end 720*a* slidingly disposed in the top surface 700*a* of the paper tray 700 and a second end 720*b* disposed on the elongated strip 702. Preferably, the second end 720*b* of the shafts 720 are press fit or tack welded into corresponding openings in the elongated strip 702 and the first ends 720*a* slide within corresponding holes on the top surface 700 of the paper tray 700. The first ends 720*a* also have a lip 720*c* for preventing the first ends 720*a* from coming free from their corresponding holes. Biasing means, such as a compression spring 722, are disposed around each shaft 720 for biasing the elongated strip 702 toward the top surface 700*a* of the paper tray 700. The compression springs 722 are also disposed between the top surface 700*a* of the paper tray 700 and the lip 720*c* at the first ends 720*a* of the shafts 720.

Figure 10:
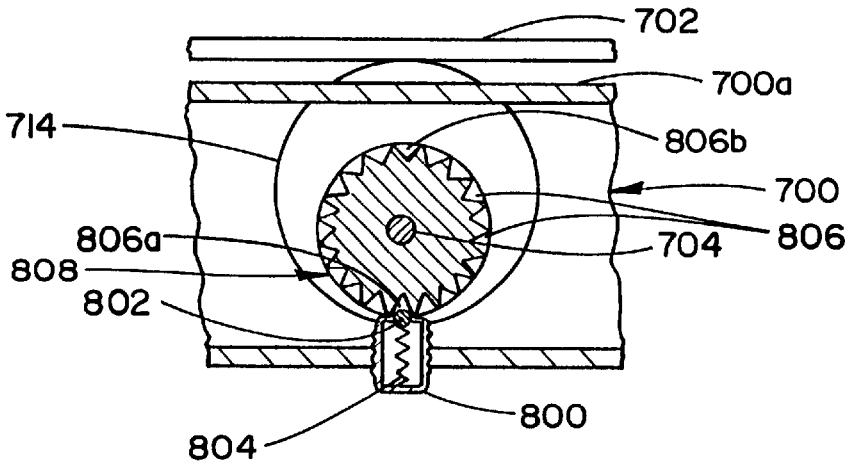
FIG. 10 is a partial sectional view of the locking means of the feed enhancer of FIG. 8A taken along line 10—10.

Referring now to FIG. 10, the third embodiment of the feed enhancer of the present invention also preferably includes a locking means for locking the elongated strip 702 at a predetermined height above the top surface 700*a* of the paper tray 700. The locking means preferably comprises a ball detent 800 disposed on the paper tray 700. The ball detent 800 generally has a threaded body which mates with a corresponding threaded hole in the paper tray 700. The ball detent 800 also has a ball 802 retained therein and biased towards the shaft 704 by a biasing means, such as a compression spring 804. A plurality of detents 806, which are preferably conical shaped cavities, are disposed around the circumference of the shaft 704.

The detents can be disposed on the shaft 704 itself or alternatively, on a disk 808 retained on the shaft 704, preferably with a set screw or by press fitting. The ball 802 engages a corresponding detent 806*a* and is retained therein by the biasing force of the spring 804 thereby locking the elongated strip 702 at a height above the top surface 700*a* of the paper tray 700 corresponding to the circumferential location of the engaged detent 806*a* on the shaft 704.

Figure 8A:
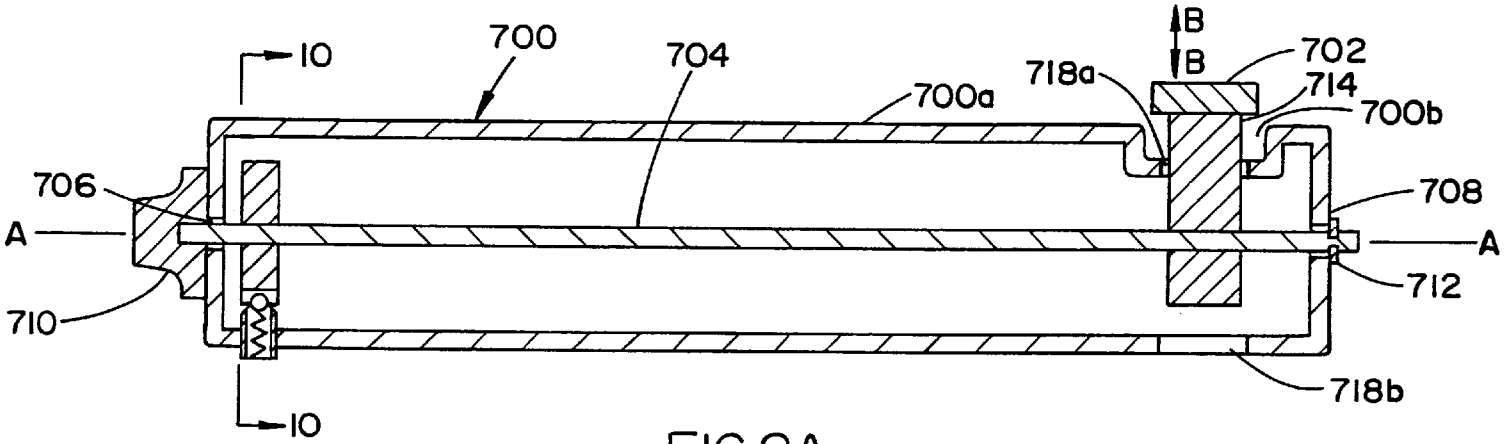
FIGS. 8A and 8B are side sectional views of the feed enhancer of FIG. 7 taken along line 8—8, FIG. 8A illustrating the elongated strip at a heightened position above the top surface of the paper tray, FIG. 8B illustrating the elongated strip flush with the top surface of the paper tray.
Figure 8B:
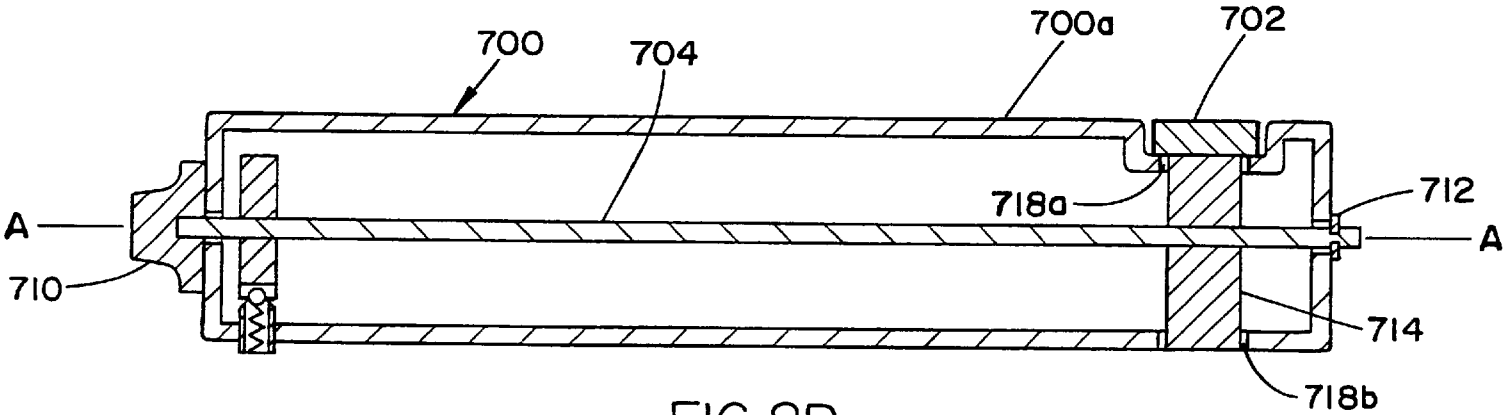
Figure 9A:
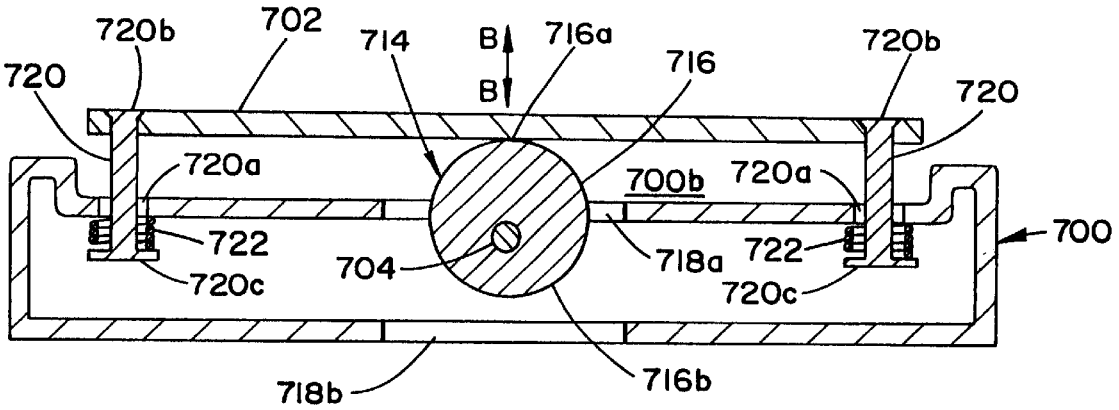
FIGS. 9A and 9B are front sectional views of the feed enhancer of FIG. 7 taken along line 9—9, FIG. 9A illustrating the elongated strip at a heightened position above the top surface of the paper tray, FIG. 9B illustrating the elongated strip flush with the top surface of the paper tray.
Figure 9B:
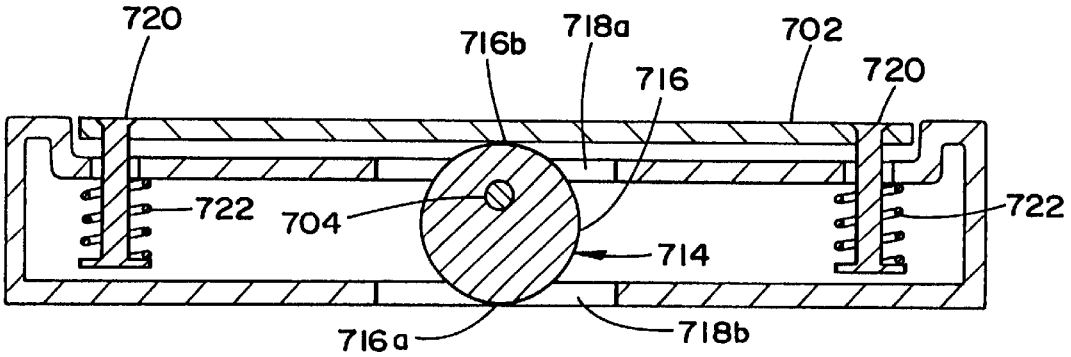

It can be appreciated that as the knob 710, shaft 704, and cam 714 attached thereto are rotated towards detent 806*b* the weight of the elongated strip 702 and the biasing force of springs 722 will bring the elongated strip 702 into contact with the outer surface 716 of the cam 714. The elongated strip 702 is at its lowest height with respect to the top surface 700*a* of the paper tray 700 when the portion of the cam 716*b* faces the elongated strip 702, as shown in FIGS. 8B and 9B. In this position, portion 716*a* of the cam 714 will retreat into opening 718*b*. Preferably, the paper tray 700 includes a recess 700*b*, so that the elongated strip 702 is flush with the top surface 700*a* of paper tray 700.

Obviously, the height of the elongated strip 702 above the top surface 700*a* of the paper tray 700 is variable depending upon the particular detent 806 engaged with the ball 802. The incremental amount that the height can be adjusted is dependent upon the number of detents 806 disposed about the circumference of the shaft 704, or alternatively, the disk 808.

In operation, the rotation of knob 710 results in the height of the elongated strip 702 above the top surface 700*a* of the paper tray 700 to increase or decrease depending on the distance from the central axis A—A of the shaft 704 to the portion of the outer surface 716 in contact with the elongated strip 702.

The various embodiments of the feed enhancer of the present invention are illustrated as being in close proximity to the pick roller 104. However, it should be apparent to those skilled in the art that the feed enhancers can be placed at various points along the length of the paper to be fed into the printer without departing from the scope or spirit of the present invention.

From the foregoing description, it can be appreciated by someone skilled in the art that the adjustment means can be utilized to offset varying degrees of height and unevenness in paper stacks. If the unevenness of the paper stack is severe, the height of the elongated strip can be increased as described. Alternatively, if the unevenness of the paper stack is minor, the height of the elongated strip can be decreased. The simplicity, inexpensiveness, and ease of retrofitting existing printers with the feed enhancer embodiments of the present invention, particularly the first embodiment illustrated in FIG. 4, can also be appreciated by an artisan skilled in the art.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

I claim:

1. A feed enhancer for eliminating an unevenness in height from a paper stack to be printed by a printer, the printer having a paper feeder including a paper tray for storage of the paper stack on a top surface thereof and for feeding individual paper from the paper stack into the printer for subsequent printing, the feed enhancer comprising;

an elongated strip disposed at the top surface of the paper tray and positioned perpendicular to a direction in which the individual paper is fed into the printer such that the feed enhancer evens out the unevenness in height of the paper stack in an area of the paper stack that is to be fed into the printer; and mounting means for mounting the elongated strip to the top surface of the paper tray wherein the top surface of the paper tray is ferric and the mounting means is a magnetic strip fastened to the elongated strip whereby the elongated strip is mounted to the top surface of the paper tray by a magnetic attraction between the magnetic strip attached thereto and the top surface of the paper tray.

2. The feed enhancer according to claim 1, wherein the elongated strip has a length substantially equal to the width of the paper in the direction perpendicular to which the individual paper is fed into the printer.

3. The feed enhancer according to claim 1, further comprising a mounting means for mounting the elongated strip to the top surface of the paper tray.

4. The feed enhancer according to claim 1, wherein the magnetic strip is fastened to the elongated strip with an adhesive.

5. A printer tray for eliminating an unevenness in height from a paper stack to be printed by a printer, the printer having a paper feeder including the paper tray for storage of the paper stack on a top surface thereof and for feeding individual paper from the paper stack into the printer for subsequent printing, the printer tray comprising;

a feed enhancer having a heightened portion disposed at the top surface of the paper tray and positioned perpendicular to a direction in which the individual paper is fed into the printer such that the feed enhancer evens out the unevenness in height of the paper stack in an area of the paper stack that is to be fed into the printer, wherein the heightened portion comprises an elongated strip and the elongated strip has a width substantially equal to the width of the paper in the perpendicular direction in which the individual paper is fed into the printer; and mounting means for mounting the elongated strip to the top surface of the paper tray, wherein the top surface of the paper tray is ferric and the mounting means is a magnetic strip fastened to the elongated strip whereby the elongated strip is mounted to the top surface of the paper tray by a magnetic attraction between the magnetic strip attached thereto and the top surface of the paper tray.

6. The printer tray according to claim 5, wherein the magnetic strip is fastened to the elongated strip with an adhesive.

7. A printer for eliminating an unevenness in height from a paper stack to be printed, the printer having a paper feeder including a paper tray for storage of the paper stack on a top surface thereof and for feeding individual paper from the paper stack into the printer for subsequent printing, the printer comprising;

a feed enhancer having a heightened portion disposed at the top surface of the paper tray and positioned perpendicular to a direction in which the individual paper is fed into the printer such that the feed enhancer evens out the unevenness in height of the paper stack in an area of the paper stack that is to be fed into the printer, wherein the heightened portion comprises an elongated strip; and mounting means for mounting the elongated strip to the top surface of the paper tray, wherein the top surface of the paper tray is ferric and the mounting means is a magnetic strip fastened to the elongated strip whereby the elongated strip is mounted to the top surface of the paper tray by a magnetic attraction between the magnetic strip attached thereto and the top surface of the paper tray.

8. The printer according to claim 7, wherein the elongated strip has a width substantially equal to the width of the paper in the perpendicular direction in which the individual paper is fed into the printer.

9. The printer according to claim 7, wherein the magnetic strip is fastened to the elongated strip with an adhesive.

10. A printer tray for eliminating an unevenness in height from a paper stack to be printed by a printer, the printer having a paper feeder including the paper tray for storage of the paper stack on a top surface thereof and for feeding individual paper from the paper stack into the printer for subsequent printing, the printer tray comprising a feed enhancer having a heightened portion disposed at the top surface of the paper tray and positioned perpendicular to a direction in which the individual paper is fed into the printer such that the feed enhancer evens out the unevenness in height of the paper stack in an area of the paper stack that is to be fed into the printer, wherein the heightened portion comprises a stepped portion integral in one piece with the top surface of the paper tray.

11. The printer tray according to claim 10, wherein the stepped portion has a width substantially equal to the width of the paper in the perpendicular direction in which the individual paper is fed into the printer.

12. A printer tray for eliminating an unevenness in height from a paper stack to be printed by a printer, the printer having a paper feeder including the paper tray for storage of the paper stack on a top surface thereof and for feeding individual paper from the paper stack into the printer for subsequent printing, the printer tray comprising a feed enhancer having a heightened portion disposed at the top surface of the paper tray and positioned perpendicular to a direction in which the individual paper is fed into the printer such that the feed enhancer evens out the unevenness in height of the paper stack in an area of the paper stack that is to be fed into the printer, wherein the heightened portion comprises an elongated strip and an adjustment means for adjusting the height of the elongated strip above the top surface of the paper tray, the adjustment means comprising:

a shaft rotatably disposed in the paper tray;

a cam disposed on the shaft, the cam having an outer surface which varies in distance from a central axis of the shaft, a portion of the outer surface being in contact with the elongated strip;

retaining means for retaining the elongated strip along a path perpendicular to the top surface of the paper tray; and a knob rotatably engaged with the shaft and accessible from a front of the paper tray for rotating the cam about the shaft, the rotation of which resulting in the height of the elongated strip above the top surface of the paper tray to increase or decrease depending on the distance from the central axis of the shaft to the portion of the outer surface in contact with the elongated strip.

13. The printer tray according to claim 12, wherein the retaining means comprises:

at least two shafts perpendicular to the elongated strip, the shafts having a first end fixed on the elongated strip and a second end slidingly disposed on the top surface of the paper tray; and biasing means for biasing the elongated strip toward the top surface of the paper tray.

14. The printer tray according to claim 13, wherein the biasing means comprises a compression spring disposed around each shaft between the top surface of the paper tray and a lip at the second end of the shafts.

15. The printer tray according to claim 12, further comprising a locking means for locking the elongated strip at a predetermined height above the top surface of the paper tray.

16. The printer tray according to claim 15, wherein the locking means comprises:

a ball detent disposed on the paper tray, the ball detent having a ball retained therein, the ball being biased towards the shaft by a biasing means; and a plurality of detents disposed around the circumference of the shaft, whereby the ball engages a corresponding detent and is retained therein by the biasing force of the biasing means thereby locking the elongated strip at a height above the top surface of the paper tray corresponding to the circumferential location of the engaged detent on the shaft.

17. A printer for eliminating an unevenness in height from a paper stack to be printed, the printer having a paper feeder including a paper tray for storage of the paper stack on a top surface thereof and for feeding individual paper from the paper stack into the printer for subsequent printing, the printer comprising a feed enhancer having a heightened portion disposed at the top surface of the paper tray and positioned perpendicular to a direction in which the individual paper is fed into the printer such that the feed enhancer evens out the unevenness in height of the paper stack in an area of the paper stack that is to be fed into the printer, wherein the heightened portion comprises a stepped portion integral in one piece with the top surface of the paper tray.

18. The printer according to claim 17, wherein the stepped portion has a width substantially equal to the width of the paper in the perpendicular direction in which the individual paper is fed into the printer.

19. A printer for eliminating an unevenness in height from a paper stack to be printed, the printer having a paper feeder including a paper tray for storage of the paper stack on a top surface thereof and for feeding individual paper from the paper stack into the printer for subsequent printing, the printer comprising a feed enhancer having a heightened portion disposed at the top surface of the paper tray and positioned perpendicular to a direction in which the individual paper is fed into the printer such that the feed enhancer evens out the unevenness in height of the paper stack in an area of the paper stack that is to be fed into the printer, wherein the heightened portion comprises an elongated strip and an adjustment means for adjusting the height of the elongated strip above and parallel to the top surface of the paper tray.

20. The printer according to claim 19, wherein the adjustment means comprises:

a shaft rotatably disposed in the paper tray;

a cam disposed on the shaft, the cam having an outer surface which varies in distance from a central axis of the shaft, a portion of the outer surface being in contact with the elongated strip;

retaining means for retaining the elongated strip along a path perpendicular to the top surface of the paper tray; and a knob rotatably engaged with the shaft and accessible from a front of the paper tray for rotating the cam about the shaft, the rotation of which resulting in the height of the elongated strip above the top surface of the paper tray to increase or decrease depending on the distance from the central axis of the shaft to the portion of the outer surface in contact with the elongated strip.

21. The printer according to claim 20, wherein the retaining means comprises:

at least two shafts perpendicular to the elongated strip, the shafts having a first end fixed on the elongated strip and a second end slidingly disposed on the top surface of the paper tray; and biasing means for biasing the elongated strip toward the top surface of the paper tray.

22. The printer according to claim 21, wherein the biasing means comprises a compression spring disposed around each shaft between the top surface of the paper tray and a lip at the second end of the shafts.

23. The printer according to claim 20, further comprising a locking means for locking the elongated strip at a predetermined height above the top surface of the paper tray.

24. The printer according to claim 23, wherein the locking means comprises:

a ball detent disposed on the paper tray, the ball detent having a ball retained therein, the ball being biased towards the shaft by a biasing means; and a plurality of detents disposed around the circumference of the shaft, whereby the ball engages a corresponding detent and is retained therein by the biasing force of the biasing means thereby locking the elongated strip at a height above the top surface of the paper tray corresponding to the circumferential location of the engaged detent on the shaft.

* * * * *